US005104014A

United States Patent [19]

Flynn

[11] Patent Number: 5,104,014

[45] Date of Patent: Apr. 14, 1992

[54] TRAPUNTO ROD TO STUFF QUILTED ITEMS

[75] Inventor: John F. Flynn, 2302 S. 40th St. W., Billings, Mont. 59106

[73] Assignee: John F. Flynn, Billings, Mont.

[21] Appl. No.: 521,597

[22] Filed: Jun. 28, 1990

[51] Int. Cl.[5] ..... A41H 43/00; D05B 11/00

[52] U.S. Cl. ..... 223/1; 221/279; 112/117; 112/1

[58] Field of Search ..... 223/1, 102; 112/117, 112/1; 221/279; 99/494, 450.5, 450.6, 419; 273/428, 23, 24; 5/482, 502; 53/521, 524; 124/65, 66, 67, 68

[56] References Cited

U.S. PATENT DOCUMENTS

| | | | |
|---|---|---|---|
| Re. 16,283 | 3/1926 | Mitchell | 53/521 |
| 845,151 | 2/1907 | Weber | 223/102 |
| 3,137,287 | 6/1964 | Arbun | 273/428 |
| 3,183,002 | 5/1965 | Updaw | 273/428 |
| 3,766,902 | 10/1973 | Repinski | 273/428 |
| 4,814,218 | 3/1989 | Shane | 112/266.1 |
| 4,949,415 | 8/1990 | Selga | 5/482 |

FOREIGN PATENT DOCUMENTS

| | | | |
|---|---|---|---|
| 481765 | 3/1938 | United Kingdom | 223/1 |

*Primary Examiner*—Werner H. Schroeder
*Assistant Examiner*—Bibhu Mohanty

[57] ABSTRACT

A device for adding extra stuffing to quilted items. A trapunto rod consists of a tube 10 which holds the stuffing material, an ejection means (piston) 14 driven by a linear drive means (inner rod) 12 which slides inside the tube and ejects the stuffing material at a specific location between the layers of a quilted item, and a handle 16 which stops the piston at its ejecting limit.

1 Claim, 1 Drawing Sheet

TRAPUNTO ROD TO STUFF QUILTED ITEMS

BACKGROUND

1. Field of Invention

This invention improves on the traditional method of creating trapunto.

2. Background Description of Prior Art

Trapunto is a needlework process in which extra stuffing is added to small areas of quilting for extra dimension. Traditionally, this is accomplished by cutting the fabric on the back of the quilted item, inserting some extra stuffing material and then hand sewing the cut closed. This cutting and resewing of the fabric weakens the item and diminishes the aesthetics of the piece. It is also very time consuming.

OBJECTS AND ADVANTAGES

The Trapunto Rod allows a quilter to inject extra stuffing into a quilted item. This is accomplished by putting a small amount of stuffing material into the end of the Trapunto Rod tube. The Trapunto Rod is then worked between the layers from the edge of the item being quilted to the area for trapunto. When the Trapunto Rod is in position, the quilter simply ejects the stuffing with the piston. The Trapunto Rod is removed and refilled, and the process continues.

Using the Trapunto Rod has three distinct advantages over the traditional method:

The structural integrity of the backing fabric is maintained, since there is no cutting to insert the extra stuffing material.

The aesthetics of the quilted item are not diminished by cutting and resewing.

And, for most quilters, using the Trapunto Rod will be faster than the traditional method.

DRAWING FIGURES

REFERENCE NUMERALS IN DRAWINGS

Figures 1, 2:
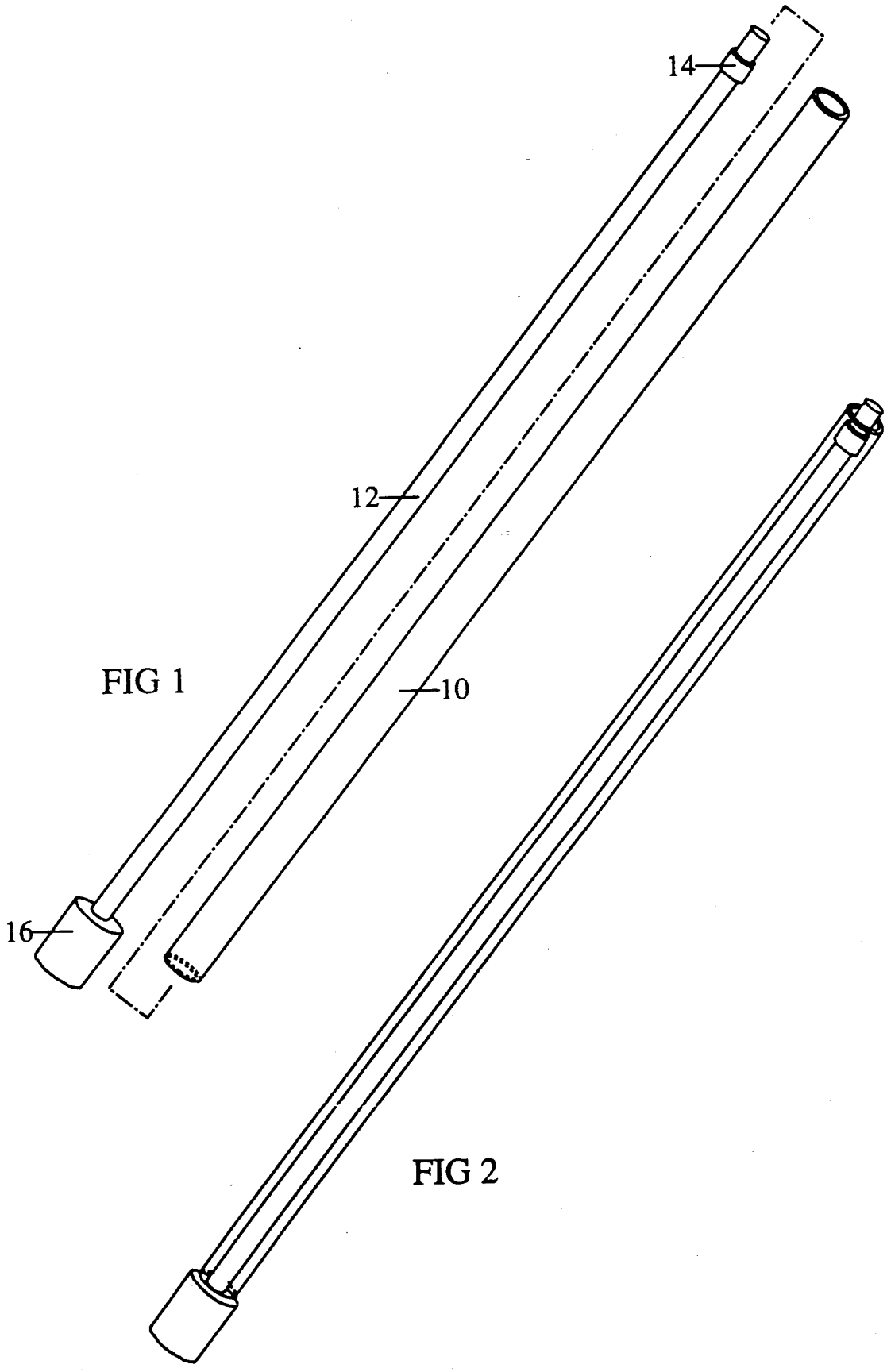
FIG. 1 shows the four pieces of a Trapunto Rod—a tube, a linear drive means, an ejection means, and a handle.
FIG. 2 shows an assembled Trapunto Rod.

10 tube
12 linear drive means
14 ejection means
16 handle

DESCRIPTION—FIGS. 1 AND 2

A typical embodiment of the tube 10 is illustrated in FIG. 1. The preferred embodiment of the tube 10 is ¼"i.d. clear CAB tubing.

A typical embodiment of the linear drive means 12 is illustrated in FIG. 1. The preferred embodiment of the linear drive means 12 is 3/16"d. acrylic rod with ½" handle (stop).

A typical embodiment of the ejection means 14 is illustrated in FIG. 1. The preferred embodiment of the ejection means is a bushing that fits tightly on the 3/16"d. rod 12 and snugly within the bore of the tube 10.

The length of the assembly in FIG. 2 varies to suit the size of the quilted item.

OPERATION—FIGS. 1 AND 2

The ejection means (piston) 14 and linear drive means (inner rod) 12 fit into the tube 10 as illustrated in FIG. 2. A small amount of stuffing material is placed in the end of the tube. The inner rod is used to push the piston and hence the stuffing out of the tube and into position within the item being quilted. The inner rod has a handle 16 on one end which stops the piston at its ejecting limit. The piston fits the tube snugly to prevent the stuffing from working its way down into the tube.

The Trapunto Rod allows a quilter to inject extra stuffing into a quilted item without cutting the backing fabric. A Trapunto Rod of at least one half the width of the quilted item is necessary to reach the center of the item. The Trapunto Rod is worked between the layers of the item being quilted, from the edge of the item to the area for trapunto. When the Trapunto Rod is in position, a quilter simply ejects the stuffing with the piston. The Trapunto Rod is removed, the tube is refilled, and the process continues.

SUMMARY, RAMIFICATIONS AND SCOPE

The reader will see that the trapunto rod has distinct advantages over the traditional method used to add extra stuffing to quilted projects in that

- it eliminates cutting of the backing fabric and subsequent mending of the cuts;
- it preserves the structural integrity of the fabric;
- it looks better, especially on the back where there are no cuts and mends;
- it is faster.

Although the description above contains many specificities, these would not be construed as limiting the scope of the invention but as merely providing illustrations of some of the presently preferred embodiments of this invention. For example, the tube and linear drive means (inner rod) could be flexible; the tube could have diameters much smaller or much larger for quilting items at either extreme.

Thus the scope of the invention should be determined by the appended claims and their legal equivalents, rather than by the examples given.

I claim:

1. A device for placing additional stuffing at a specific location in a quilted item, comprising:

a. a tube of a size which will accommodate a desired amount of stuffing and which will easily slide between layers of a quilted item, said tube having enough structural integity to allow the leading end of the tube to be directed to the desired location in a quilted item, and b. an ejection means which will slide freely yet fit snugly within the bore of said tube and which in its delivery position extends beyond said tube leading end thus ejecting any stuffing which has been carried in said tube into its desired position within said quilted item, and c. a linear drive means that will cause said ejection means to travel from a retracted mode to an ejection mode forcing said stuffing to be ejected at the desired location within said quilted item.

* * * * *